US006883642B2

(12) United States Patent
Matty

(10) Patent No.: US 6,883,642 B2
(45) Date of Patent: Apr. 26, 2005

(54) METHOD OF LADDER-SUPPORTED SCAFFOLD ERECTION, AND LADDER BRACING AND SCAFFOLDING SYSTEM FOR USE THEREWITH

(76) Inventor: Larry Matty, 44 Osgood Rd., Sanborton, NH (US) 03269

( * ) Notice: Subject to any disclaimer, the term of this patent is extended or adjusted under 35 U.S.C. 154(b) by 0 days.

(21) Appl. No.: 09/954,279

(22) Filed: Sep. 17, 2001

(65) Prior Publication Data

US 2003/0051943 A1 Mar. 20, 2003

(51) Int. Cl.[7] ..... E06C 7/16
(52) U.S. Cl. ..... 182/117; 182/107
(58) Field of Search ..... 182/117, 118, 182/121, 107, 114

(56) References Cited

U.S. PATENT DOCUMENTS 567,755 A * 9/1896 Stillman ..... 248/238
623,269 A * 4/1899 Wilber ..... 182/103
2,897,013 A * 7/1959 Delp ..... 182/108
3,026,963 A * 3/1962 Wilkie ..... 182/119
3,437,296 A * 4/1969 Hinz
3,476,212 A * 11/1969 Eakins ..... 182/103
4,643,275 A * 2/1987 LeBlanc ..... 182/107
4,941,547 A * 7/1990 Livick ..... 182/107
6,109,391 A * 8/2000 Tyson ..... 182/117

* cited by examiner

*Primary Examiner*—Alvin Chin-Shue
(74) *Attorney, Agent, or Firm*—Rines and Rines

(57) ABSTRACT

An improved ladder-supported scaffolding technique and system using a pair of horizontally spaced vertical ladders for supporting staging planks therebetween and held vertically and rigidly by top brackets parallely in front of, along, and spaced from a building structure, and having adjustable brackets attachable to intermediate ladder rungs with staging plank-supporting legs perpendicularly extending toward or away from the building structure.

8 Claims, 5 Drawing Sheets

METHOD OF LADDER-SUPPORTED SCAFFOLD ERECTION, AND LADDER BRACING AND SCAFFOLDING SYSTEM FOR USE THEREWITH

FIELD

The present invention relates to scaffold structures and scaffolding techniques for use in building or other structural construction or repair operations and the like; being more particularly directed to ladder-supported scaffolding.

BACKGROUND

The art is replete with all kinds of scaffolding and staging constructions, ranging from specially designed vertical staging pole systems, such as the "Alum-A-Pole System" of Harvey Industries, as described in their 1997 "Quality Building Products" catalog, to simpler proposals that employ ladders and step-ladders as supporting elements, as, for example, in U.S. Pat. No. 6,148,957 and the patent references cited therein; and also in U.S. Pat. No. 5,020,757 as another example, and even as far back as 1897 in U.S. Pat. No. 596,161 where a single vertical ladder scaffold was attached to a building oriented at right angles to the building. In the painting and construction trades, however, the almost universal practice has required that the elevated or erected ladder be supported inclined against the side wall of the building or other structure.

The discovery of the present invention resides in a novel way in which everyday ladders may actually be independently used to substitute for and to attain the advantages of the before-mentioned specialized and widely used vertical staging pole structures, but without the costs thereof.

The invention, furthermore, provides improved and safer and more facile operation then can be obtained by the use of ladders inclined against buildings; such being subject to the great dangers of lateral slipping and collapsing to the ground, or the outward slipping of the bottom foot ends of the ladder in response to the inherent forces pushing the legs away from the building as the ladder is ascended or descended. In addition, where one merely attaches horizontal staging platforms or boards between a pair of such ladders, the system is always inherently unstable and even tends to bounce in use. Still, this has been the best that the industry has had to use, particularly for home construction and repairs, and despite these limitations.

In accordance with the invention, on the other hand, pairs of every-day ladders may be rigidly held vertically spaced parallel to the side of the building in a structural assembly that admirably obviates all of the disadvantages, danger and limitations including those above described, residing in the use of ladders inclined against the building. To accomplish this result, a pair of braces is used, attachable between a rung near or at the top of the ladder and extending horizontally to opposed regions of the building. The braces are preferably of substantially V-shape, having horizontally extending fixed brace arms and diverging pivotable arms, all provided with fitments at their free ends for attachment to corresponding opposing regions of the building, thereby to provide a horizontal line of four-point engagement with the building that holds each ladder rigidly vertically and parallely spaced from the building. While the bottom foot ends of the ladder still rest at spaced positions on the ground, there is now no force laterally pushing them outward in the use of the ladder, as occurs in the case of inclined ladders.

Such spaced vertically mounted ladders are well adapted, in accordance with a further feature of the invention, to support scaffold staging planks and the like, and also guard-rail constructions, through the use of inverted L-shaped brackets. These brackets have upper and lower terminal hooks or collars on the vertically depending leg thereof for hooking attachment over ladder rungs and there against; with the other bracket leg projecting at right angles horizontally outwardly of the ladder or inwardly toward the building (or both, where a double bracket is used). At the free end of the horizontal perpendicular leg, a vertical upwardly extending post is preferably provided to contain a staging plank supported upon and between the horizontal perpendicular bracket legs of a pair of spaced ladders of the ladder staging. The posts can also serve to receive a hollow leg of a vertical side frame of a horizontal guard-structure, wherein transversely extending rails may extend between the ladders, as later discussed, and may be telescopically or otherwise extendable or collapsible depending on the lengths required. If desired, furthermore, the bracket posts may also help support other accessory devices including winch structures and depending safety net structures and the like.

OBJECTS OF INVENTION

A primary object of the invention, accordingly, is to provide a new and improved method of paired ladder-supported staging and a novel structural system therefor, that obviate the disadvantages and dangers of prior art techniques, including those discussed above, and provide, to the contrary, a rigid, safe and highly flexible new type of inexpensive ladder-supported staging using conventional vertical ladders.

Other and further objects will be explained hereinafter and are more fully delineated in the appended claims.

SUMMARY

In summary, however, the invention embraces a method of employing a pair of similar ladders each having longitudinal sides joined by transverse rungs for use as a scaffolding structure, that comprises, erecting the ladders vertically with their bottom ends resting on the ground at horizontally spaced positions along a structure that is to accommodate the scaffolding therealong, with the ladders equally spaced in front of the structure; inserting braces extending horizontally in the space in front of the structure between corresponding upper rungs of each ladder at or near the top ends thereof and opposing regions of the structure; securing the braces between such upper rungs and such opposing structure regions to fix the ladders vertically rigidly spaced in front of and in a plane parallel to the structure; attaching brackets between corresponding intermediate rungs of each ladder at predetermined levels where scaffold planks are to be mounted to extend transversely along the structure between the ladder brackets, with each bracket having a leg extending perpendicular to the ladder either mounted in said space inwardly toward the structure or outwardly away from the ladder; and resting said plank on and between said bracket legs of each ladder bracket to serve as a scaffold platform extending and supported between the ladders.

Preferred and best mode techniques and designs are later fully detailed.

DRAWINGS

The invention will now be described in connection with the accompanying drawings, FIG. 1 of which is an isometric view of a preferred construction using the novel method of the invention;

PREFERRED EMBODIMENT(S) OF INVENTION

Figure 1:
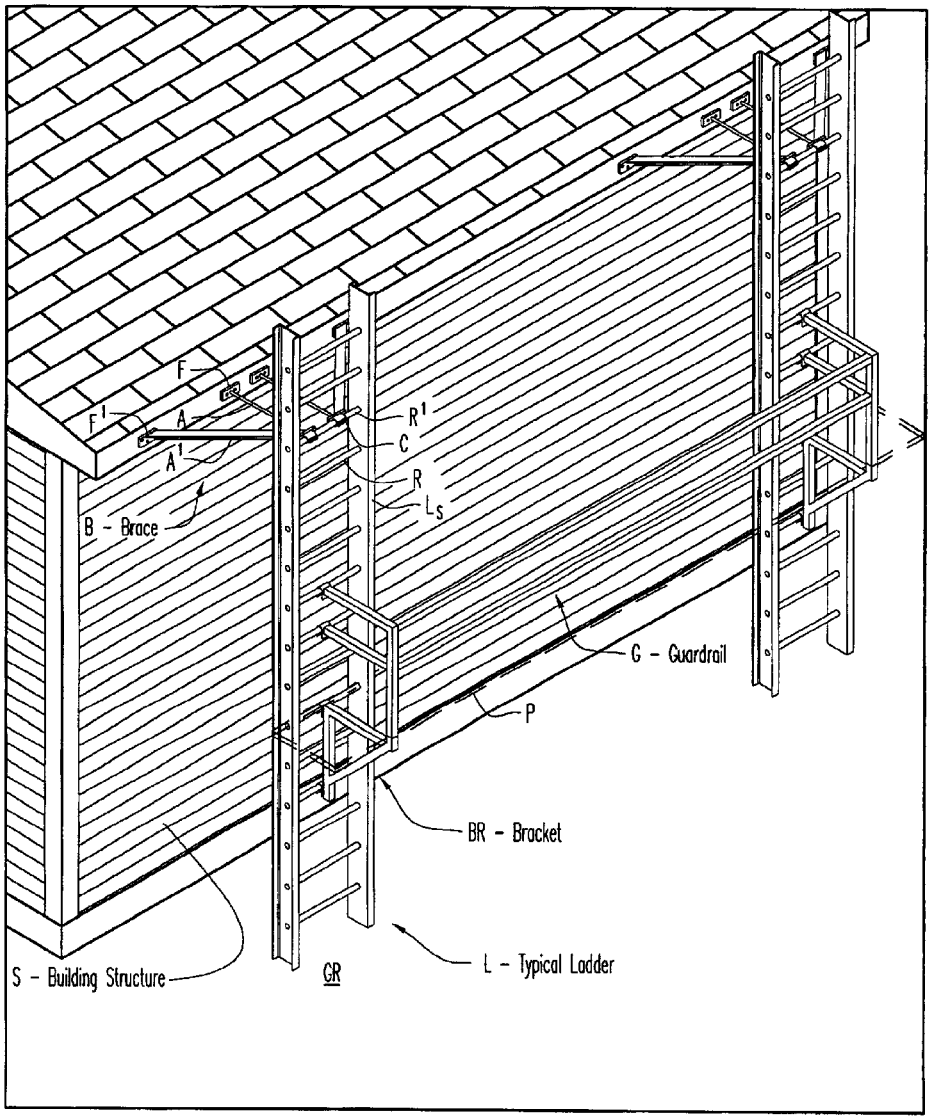

Referring to FIG. 1, a pair of conventional similar metal or other painters' ladders or the like is shown, each having longitudinal sides L joined by transverse rungs R and erected vertically, in accordance with the invention, with their bottom or foot ends shown resting on the ground GR at positions horizontally spaced along a wall of a building structure S, and equally spaced in front of the structure wall S, extending thus vertically and parallel to the front of the wall structure.

Figure 2:
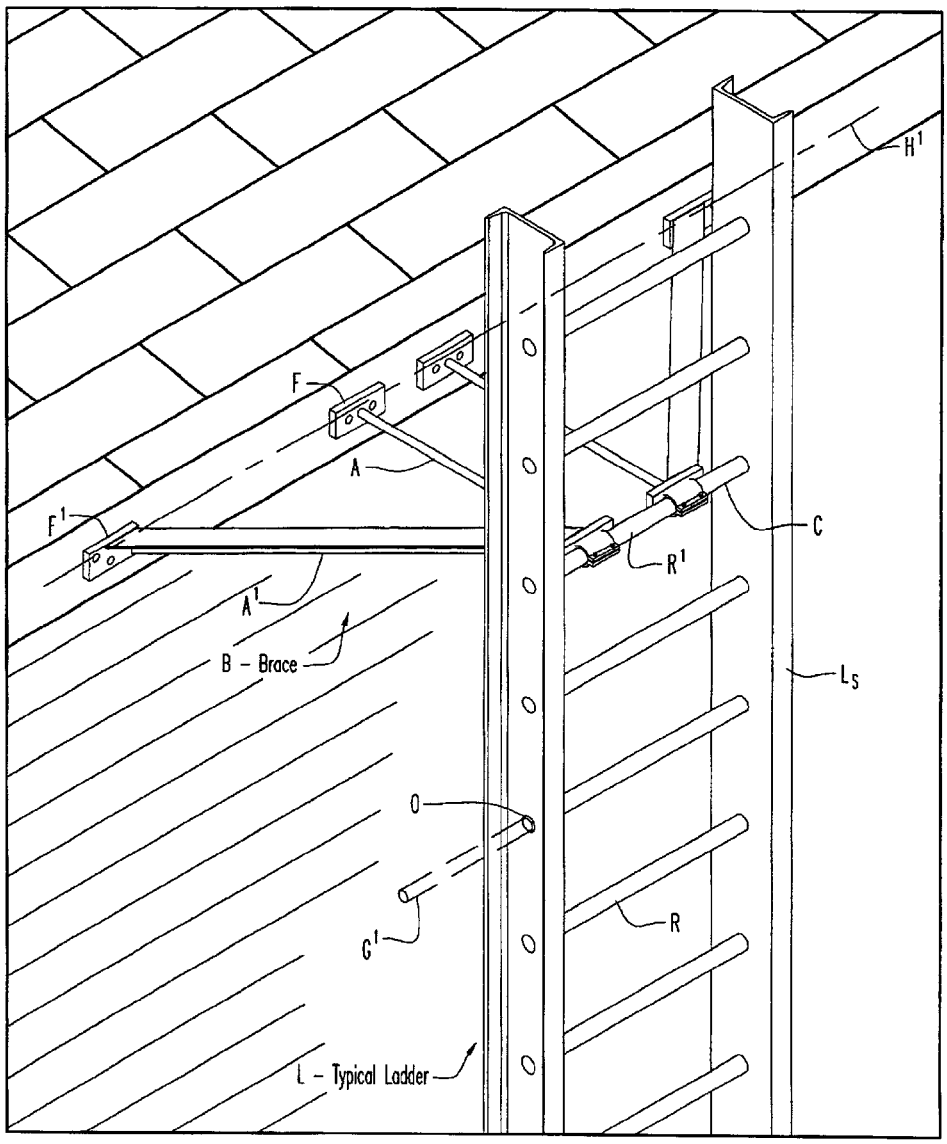
FIG. 2 is a similar view, upon an enlarged scale, detailing the ladder bracing structure of FIG. 1.

Extending horizontally from a corresponding upper rung $R^1$ of each ladder toward the wall S in the space therebetween are pairs of similar braces B, shown preferably of substantially V-shaped fixed and divergently pivotable arms A, $A^1$, secured in adjacent pairs between adjustable upper rung clamps C at their apex ends, and opposing regions of the structure S at which terminal fittings or pads F, $F^1$ at the free ends of the arms are temporarily secured, as by nailing or other temporary attachments, more clearly shown in FIG. 2. With the adjacent fixed brace arms A of each pair so attached perpendicularly at opposing regions of the top of the structure S as at F, and the pivotable arms $A^1$ attached at divergent regions $F^1$, a four-region horizontal line of attachment $H^1$ is provided, with the brace arms secured in the same horizontal rigid plane as the rung $R^1$ and the structure-attaching fittings F, $F^1$; etc., holding the pair of ladders fixed in their vertical spaced positions in front of and parallel to the wall structure S.

Figure 3:
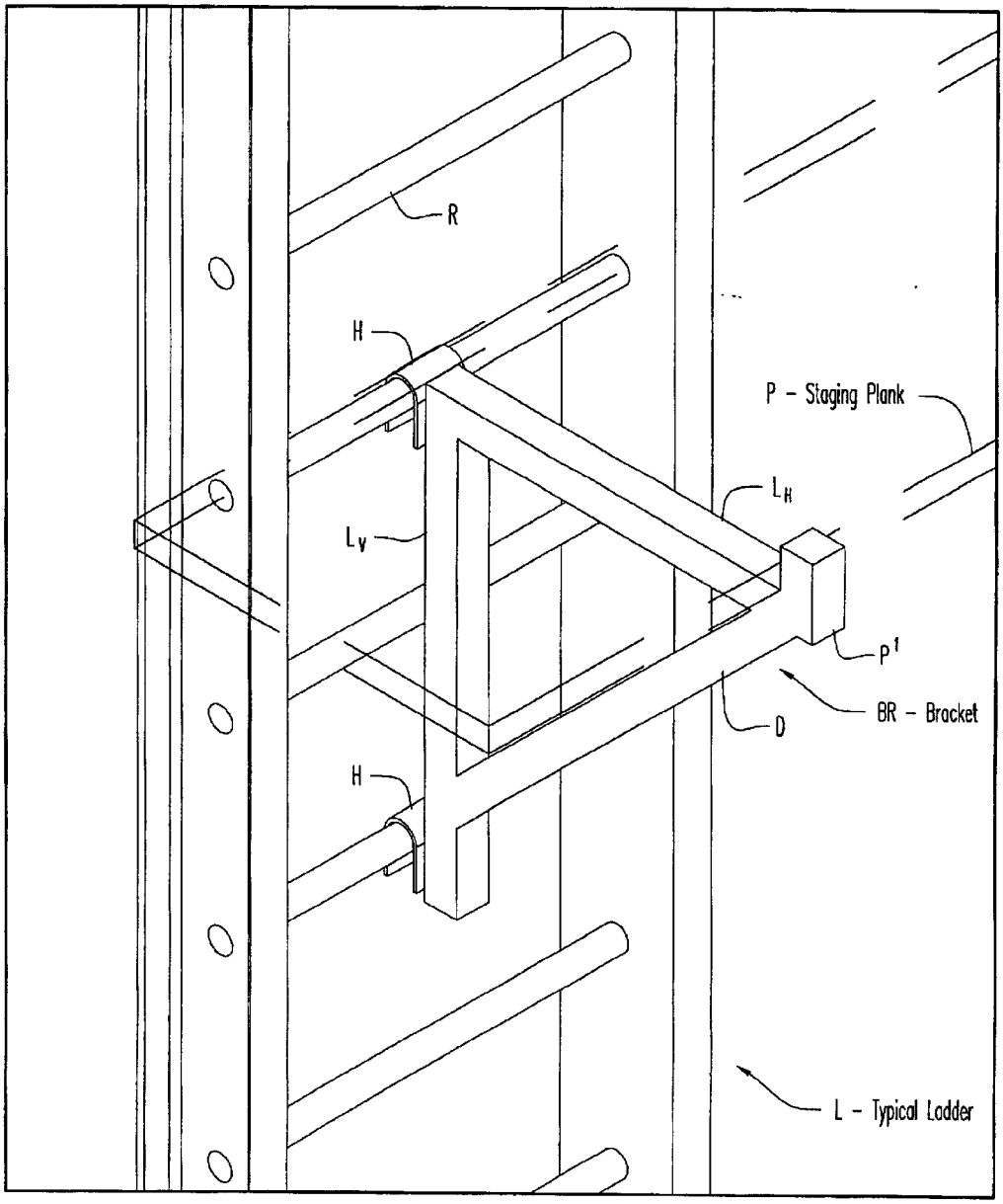
FIGS. 3 and 4 are enlarged isometrics of the ladder bracket and guardrail details, respectively.

As before mentioned, the invention enables the paired ladder structure to support planks, such as boards or aluminum or other staging surfaces P or the like, through the use of inverted L-shaped brackets BR. These are shown in more detail in FIG. 3 as mounted by integral terminal hook clamps H on the vertical leg $L_V$, that embrace selected spaced intermediate rungs at whatever predetermined height level the staging plank is desired. The hooking of the inverted vertical leg $L_V$ firmly against the ladder L enables the perpendicular leg $L_H$ of the bracket to extend horizontally outwardly outside the ladders away therefrom, as shown in FIGS. 1–3; or, if the brackets are attached on the inside of the ladder (not shown) facing the structure S, inwardly toward the structure from the inner side of the ladders in the space between the ladders and the structure. These perpendicular bracket legs $L_H$ admirably support transversely extending planks P thereupon; providing a safe staging platform extending horizontally between the ladders, as shown dotted at P in FIG. 1, and at the desired selected rung height level, either outside or inside the ladder (or both) depending upon the mounting orientation of the brackets BR. A diagonal supporting brace arm D is also shown provided for strength, as is the before-mentioned vertical post $P^1$ at the free end of the bracket arm $L_H$.

Figure 4:
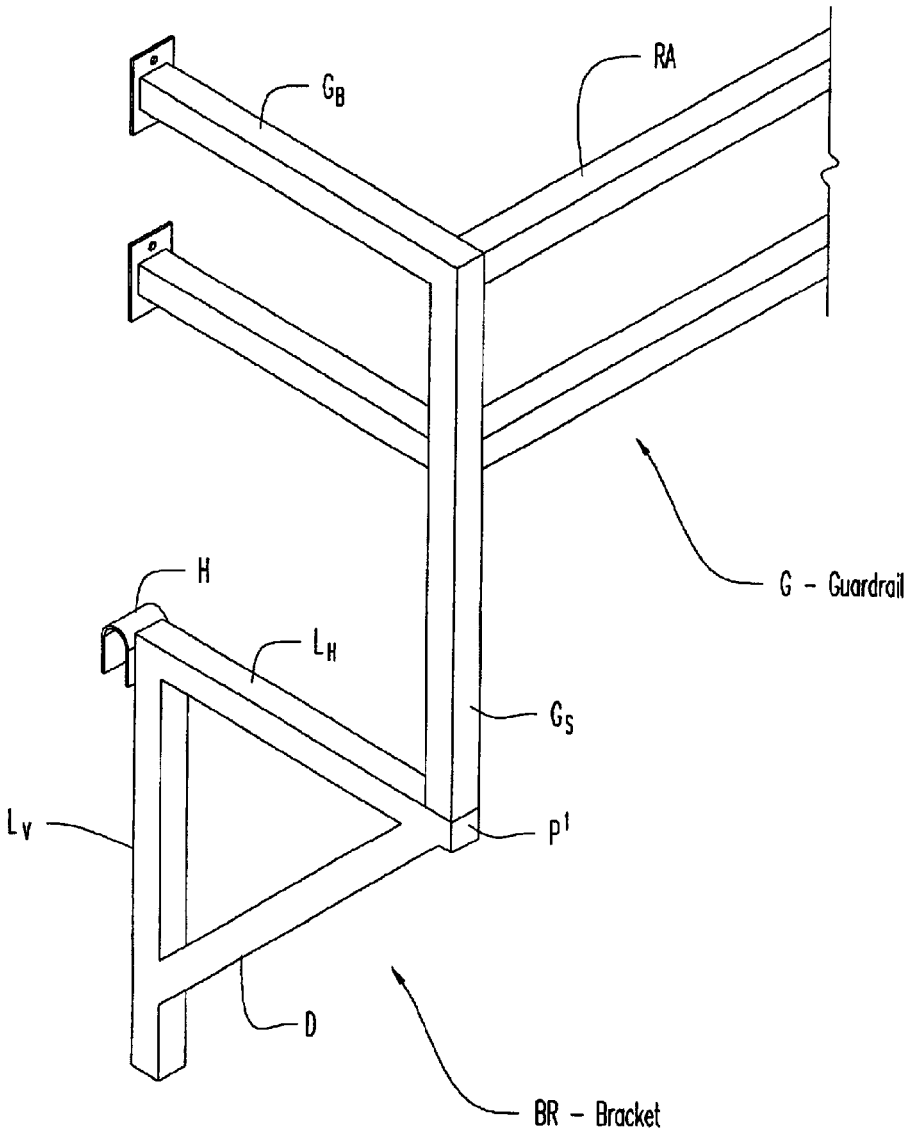

As earlier discussed, this post $P^l$ also serves to contain, stabilize or hold the plank P from laterally slipping off the supporting bracket arms $L_H$ of the pair of ladders; and it can further receive and mount a hollow vertical side frame element $G_S$ of a guardrail G, shown in dashed lines in FIG. 1 and in more detail in FIG. 4, with parallel railings RA extending horizontally parallel to the staging plank P along the structure wall S between the pair of fixed vertical ladders L. Perpendicular guardrail side braces $G_B$ either to ladder clamps or attachments or to fittings secured to the building, can add stability.

Figure 5:
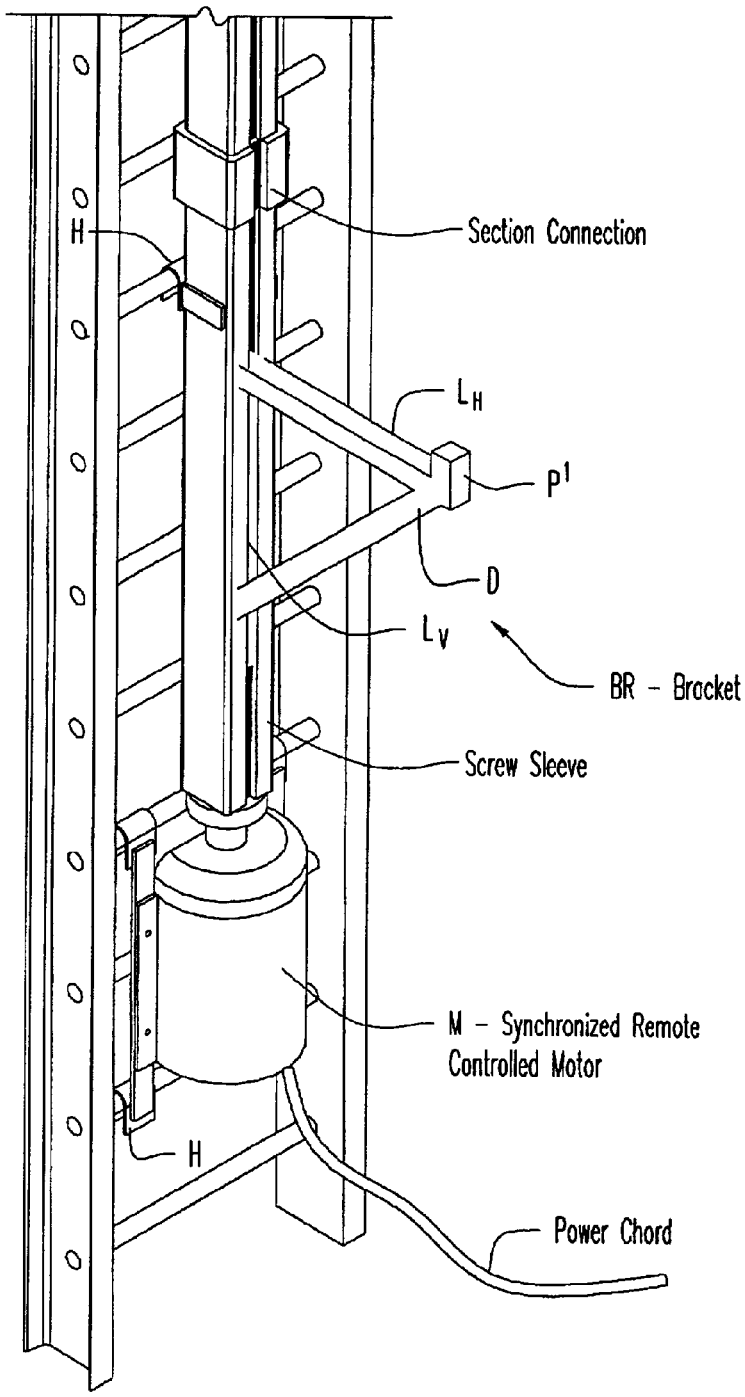
FIG. 5 illustrates an exemplary motor-driven automatic bracket and scaffold plank elevating system for adjusting height level.

An alternate guardrail structure may also be used with the system of the invention, by inserting pipe-like rails, schematically shown in dashed lines in FIG. 2, or otherwise attaching, in or to rung openings O along the ladder side rails. As earlier mentioned, moreover, while the ladder brackets BR can be manually adjusted in height level along the ladders L, correspondingly to raise or lower the scaffolding planks, FIG. 5 is an exemplary simple system for effecting such adjustment automatically with a motor M moving the bracket up-and-down the ladder along a vertical screw mounted within a sleeve, so labeled. The motor drives the screw which is attached at an upper rung of the ladder and a bearing along which the L-shaped bracket, and possibly successive such brackets in a vertical series, may be automatically raised or lowered. The motor-driven brace can be attached to both sides of the ladder and operated independently for different levels of staging. Clearly other well-known elevating systems may also readily be used, as well.

The post $P^1$ at the free end of the perpendicular bracket arm $L_H$, furthermore, as earlier mentioned, is admirably also suited to help support other accessory devices including winch structures, hanging safety nets, and the like.

Further modifications will also occur to those skilled in this art, and such are therefore considered to fall within the spirit and scope of the invention as defined in the appended claims.

What is claimed is:

1. A method of employing a pair of similar ladders each having longitudinal sides joined by transverse rungs for use as a scaffolding structure, that comprises, erecting the ladders vertically with their bottom ends resting on the ground at horizontally spaced positions along a wall of a structure that is to accommodate scaffolding therealong, with the ladders equally spaced in front of the wall with the rungs of the ladders being parallel to said wall; inserting braces extending horizontally in the space in front of the structure between corresponding upper rungs of each ladder selected below the topmost rungs thereof and opposing regions of the wall, each brace is substantially V-shaped, having a fixed arm and another arm pivotable about the apex of the V and a rung clamp at said apex, each ladder having a pair of said braces clamped to a selected upper rung, said fixed arms of said pair of braces spaced transversely along the selected rung adjacent to each other and extending perpendicularly to the rung into said space and to said opposing regions of the wall; said pivotable arms extending at an acute angle with respect to said selected rung and securing the braces between such selected upper rungs and said opposing regions in a horizontal plane therebetween lying below top ends of the ladders to fix the ladders below said top ends vertically rigidly spaced in front of and in a plane parallel to the wall; attaching brackets between corresponding intermediate rungs of each ladder at predetermined levels with a scaffold plank mounted transversely along the structure between the ladder brackets, with each bracket having a leg extending perpendicular to the ladder optionally mountable in said space inwardly toward the structure and outwardly away from the ladder; and resting said scaffold plank on and between the bracket legs of each ladder bracket to serve as a scaffold platform extending and supported between the ladders.

2. The method of claim 1 wherein each bracket is detachably mounted between rungs and positionable along its ladder to vary the height level of the scaffold platform above the ground.

3. The method of claim 2 wherein the positioning of the bracket is effected manually or automatically.

4. The method of claim 2 wherein the of bracket is effected by a bracket of inverted L shape comprising a vertically depending leg attachable against the ladder and a horizontal leg that is extended perpendicularly horizontally toward or away from said structure.

5. The method of claim 4 wherein the attaching of each bracket vertically depending leg is effected by upper and lower curved hooks embracing the adjacent ladder rungs.

6. The method of claim 5 wherein a diagonal brace arm is provided, reinforcing between the bracket legs.

7. The method of claim 5 wherein the bracket horizontal leg is provided with a terminal vertical post as for receiving the frame of a guide-rail erectable between the ladders along an edge of the scaffold.

8. The method of claim 5 wherein the longitudinal sides of the ladders are apertured at the successive rungs for receiving guardrails extending between the ladders along the scaffold platform.

* * * * *